US006401302B1

(12) United States Patent
Josserand et al.

(10) Patent No.: US 6,401,302 B1
(45) **Date of Patent: *Jun. 11, 2002**

(54) MOTOR VEHICLE OPENING LEAF HANDLE

(75) Inventors: Luc Josserand, Turin; Roberto Martino, Lanzo, both of (IT)

(73) Assignee: Valeo Securite Habitacle, Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/497,432

(22) Filed: Feb. 4, 2000

(30) Foreign Application Priority Data

Feb. 5, 1999 (FR) ..... 99 01395

(51) Int. Cl.[7] ..... E05B 3/00
(52) U.S. Cl. ..... 16/444; 292/336.3; 49/460
(58) Field of Search ..... 16/444; 292/336.3; 49/460

(56) References Cited

U.S. PATENT DOCUMENTS

| | | | | |
|---|---|---|---|---|
| 4,883,296 A | * | 11/1989 | Laurie | 292/336.3 |
| 5,101,597 A | | 4/1992 | Pelachyk et al. | |
| 5,183,302 A | * | 2/1993 | Pelachyk et al. | 292/336.3 |
| 5,263,750 A | * | 11/1993 | Smith et al. | 292/336.3 |
| 5,706,554 A | * | 1/1998 | Rückert et al. | 292/336.3 |
| 5,725,262 A | | 3/1998 | Kritzler | |
| 5,934,025 A | * | 8/1999 | Trap et al. | 49/460 |
| 6,052,948 A | * | 4/2000 | Spitzley | 49/460 |
| 6,059,329 A | * | 5/2000 | Spitzley | 292/336.3 |
| 6,167,779 B1 | * | 1/2001 | Sano et al. | 292/336.3 |

FOREIGN PATENT DOCUMENTS

| | | |
|---|---|---|
| DE | 30 30 519 | 2/1982 |
| DE | 44 33 182 | 3/1996 |
| DE | 195 24 568 | 12/1996 |
| EP | 0 681 075 | 11/1995 |

OTHER PUBLICATIONS

French Search Report dated Oct. 7, 1999.

* cited by examiner

*Primary Examiner*—Lynne H. Browne
*Assistant Examiner*—Doug Hutton
(74) *Attorney, Agent, or Firm*—Morgan&Finnegan, LLP

(57) ABSTRACT

The invention proposes a motor vehicle opening-leaf handle of the kind including a handle support which is fixed on the inside of a bodywork panel of the opening leaf, wherein the handle support includes catching tabs which attach the handle support to the panel, the support is fitted on the panel through an approach movement perpendicular to the panel, from the inside outward, during which the tabs are engaged through an opening in the panel, and through a catching movement in a direction parallel to the panel, during which the catching end of the tab comes to face an exterior face of the bodywork panel, preventing any transversely inward retreat of the tab and of the support.

18 Claims, 8 Drawing Sheets

MOTOR VEHICLE OPENING LEAF HANDLE

BACKGROUND OF THE INVENTION

The invention relates to a motor vehicle opening-leaf handle of the kind including a handle support which is fixed on the inside of an outer bodywork panel of the opening leaf.

BRIEF SUMMARY OF THE INVENTION

More specifically, the object of the invention is to allow the support to be fitted quickly and simply onto the bodywork panel. Specifically, the fixing means must be easy for the person carrying out assembly to implement and most reliably lock the support onto the panel.

To this end, the invention proposes a motor vehicle opening-leaf handle of the kind including a handle support which is fixed on the inside of an outer bodywork panel of the opening leaf, wherein the handle support includes catching tabs which attach the handle support to the panel, each tab including a linking foot and a catching end, the support is fitted on the panel through an approach movement perpendicular to the panel, from the inside outward, during which the tabs are engaged through an opening in the panel, and through a catching movement in a direction parallel to the panel, during which the catching end of the tab comes to face an exterior face of the bodywork panel, preventing any transversely inward retreat of the tab and of the support.

According to other features of the invention:

during the approach movement, the support is brought as far as an intermediate fitting position in which it is in contact with an interior face of the bodywork panel;

during the catching movement, the support is brought as far as a final position in which locking means prevent the support returning to its intermediate fitting position;

the locking means include at least one elastic arm a free end of which bears against an interior face of the bodywork panel as long as the support is between its intermediate fitting position and its final position, and, when the support reaches its final position, the end of the elastic arm collaborates with a locking cutout formed in the panel;

when the support is in the final position, the foot of at least one of the tabs bears against a bearing edge of the panel so as to determine the final position of the support;

the support includes at least two tabs which are offset one with respect to the other in a direction perpendicular to the catching direction, and the two tabs are intended to come to bear respectively against two bearing edges of the opening in the panel which are at an angle with respect to the catching direction and which run in directions which are approximately symmetric with respect to the catching direction, so as to determine the position of the support in the two directions of the plane of the panel;

the handle includes a member for grasping, which is arranged on the outside of the bodywork panel and which is fixed to the handle support;

the grasping member is articulated to the support so as to be able to be brought from a position of rest to a position for opening;

the locking means include a locking body fitted with an attachment tang which, when the handle support has reached its final position, is engaged transversely inward through an orifice made in the outer bodywork panel so as to be engaged in a complementary cavity in the handle support in such a way that a rear lateral surface of the tang bears against a rear edge of the orifice so as to prevent the assembly formed by the support and by the locking body from returning to the intermediate fitting position;

the opening leaf includes an internal space delimited by two panels, inner and outer, which are connected by an edge panel, the handle support is arranged in the interior space of the opening leaf, and the handle includes a member for immobilizing the tang in the cavity of the support, the immobilizing member being fitted so that it can move on the handle support and being maneuvered between an unlocked position and an immobilizing position by a maneuvering mechanism which can be manipulated through an opening made in the edge panel of the opening leaf;

the immobilizing member is fitted so that it can slide in the support in a direction perpendicular to the transverse direction of engagement of the locking body, and the immobilizing member includes at least one lug which, in the immobilizing position, is housed in a complementary housing in the tang of the locking body to prevent the possibility of the locking body being extracted transversely outward;

the lug and the housing collaborate via two complementary surfaces which are inclined with respect to the transverse direction of engagement of the locking body and with respect to the direction of sliding of the immobilizing member so that, when the immobilizing member is brought into its immobilizing position, the locking body is urged transversely inward by the lug of the immobilizing member;

the tang of the locking body is guided in sliding in the transverse direction in the handle support;

the immobilizing member has the shape of a U-shaped yoke with two parallel longitudinal branches connected at their rear end by a base which runs at right angles to the two branches and at right angles to the transverse direction, the yoke is introduced longitudinally from front to rear as far as a forward unlocked position, into a complementary slideway arranged at the rear of the support, and the yoke is brought by the maneuvering means longitudinally rearward as far as its immobilizing position in which the lugs formed at the front ends of each branch are engaged in corresponding housings in the tang of the locking body, the latter then being housed between the two longitudinal branches of the immobilizing yoke;

the handle support includes means for prepositioning the immobilizing member which, while the handle is being fitted, hold it in its unlocked position;

the maneuvering means consist of a threaded rod of longitudinal axis which is screwed into the base of the yoke, the front end of which bears against a surface which is longitudinally fixed, and the rear end of which exhibits a socket which complements that of a manipulating tool which can be introduced through the opening in the edge panel of the opening leaf;

the threaded rod rests against a lateral surface of the tang of the locking body; and the locking body may house a latch.

Other features and advantages of the invention will become apparent from reading the detailed description which follows, for an understanding of which reference will be made to the appended drawings, in which:

DETAILED DESCRIPTION OF THE INVENTION

Figure 1:
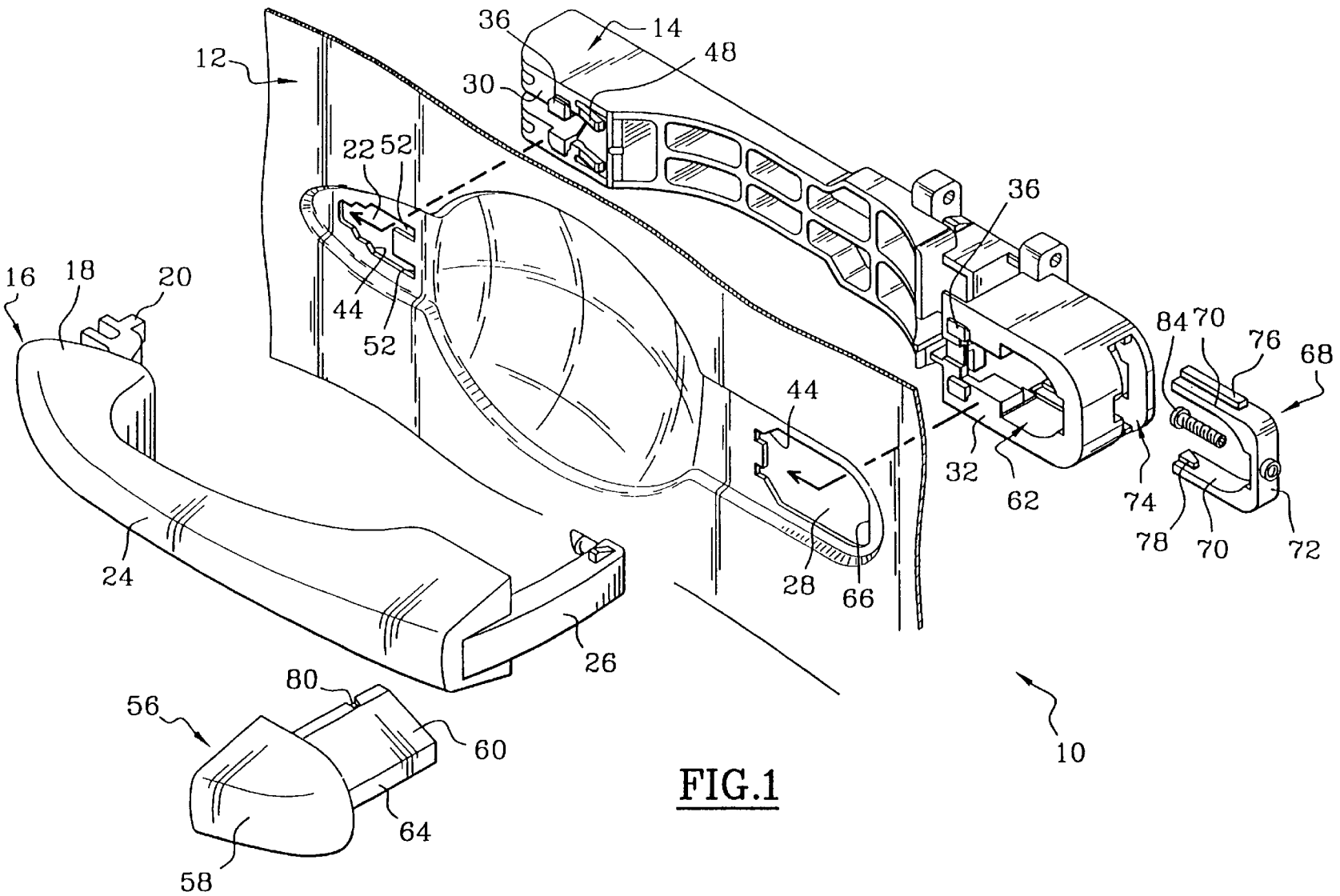
FIG. 1 is a diagrammatic exploded view in perspective of an opening-leaf handle according to the invention including a support arranged on the inside of a bodywork panel and a member for grasping arranged on the outside of the panel.

FIG. 1 illustrates a handle 10 intended to be fitted on an outer bodywork panel 12 of a motor vehicle opening leaf. The handle 10 essentially includes a handle support 14, which is intended to be fixed on the inside of the panel 12, and a lever 16 for grasping which is intended to be arranged on the outside of the panel 12, while at the same time being fixed to the support 14.

In the embodiment illustrated in the figures, the grasping lever 16 is in the form of a bar which runs in a horizontal longitudinal direction with respect to a conventional orientation of the motor vehicle, and is articulated to the support 14 by its front end 18, about a vertical axis Al (see, in particular, FIG. 6), that is to say an axis which is roughly parallel to the plane of the bodywork panel 12 and perpendicular to the longitudinal direction of the lever 16.

Of course, the ideas of the horizontal and vertical are used in this instance with a view to simplifying the understanding of the description and must not be taken to be a limitation on the scope of the invention, particularly as regards the orientation of the handle.

To articulate it to the support 14, the front end 18 of the lever 16 has a hinge element 20 which extends transversely inward through a front opening 22 formed in the panel 12 and which collaborates with a hinge element of the support 14. At its rear end 24, the grasping lever 16 has an operating element 26 which is intended to run transversely inward through a rear opening 28 made in the panel 12, so as to be able to operate a linkage associated with a lock so as to cause the opening leaf to open when the user manipulates the grasping lever 16 by moving it away from the plane of the panel 12.

Of course, the angular travel of the grasping lever 16 about the axis Al is limited by means which have not been depicted.

According to the teachings of the invention, the support 14 is equipped with means which allow the support to be fixed quickly and simply to the interior face 34 of the panel 12.

Figure 5B:
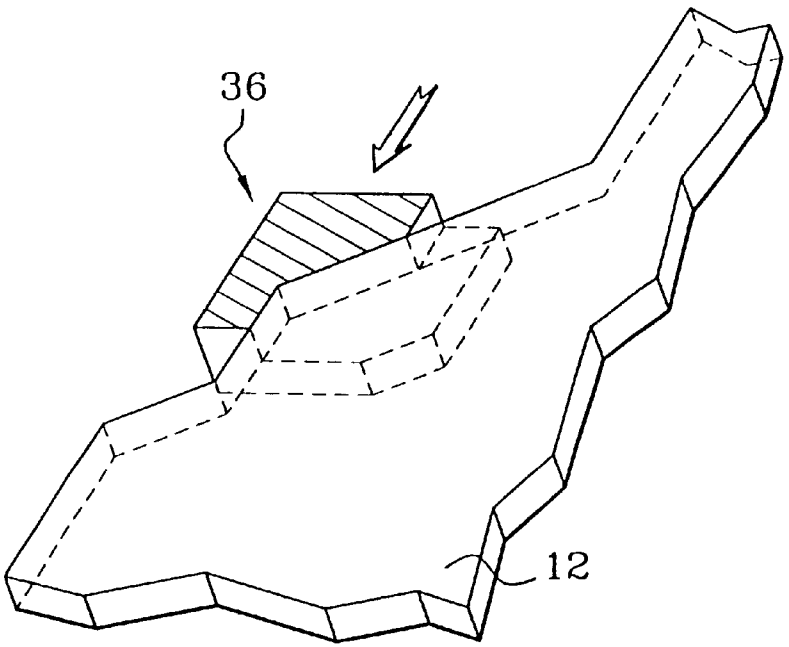
Figure 5A:
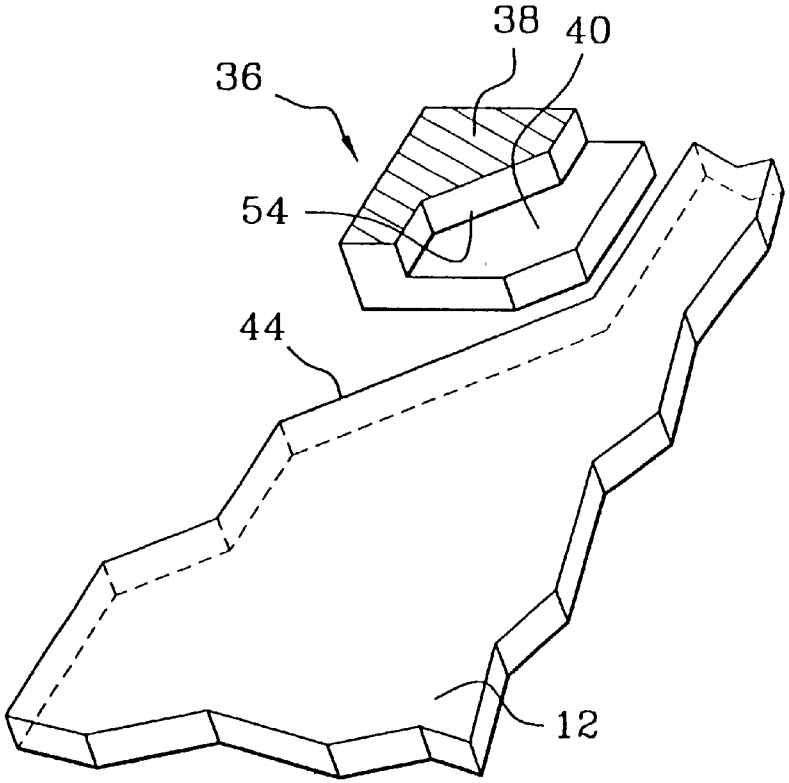
FIG. 5A is a diagrammatic perspective view more particularly illustrating a catching tab intended to bear against a bearing edge of the opening in the panel.

It may be seen in FIG. 1 that the support 14 includes a front bearing surface 30 and a rear bearing surface 32 each of which is intended to bear transversely outward against the internal face 34 of the bodywork panel. At each of these two bearing surfaces, the support 14 has attachment tabs 36 which extend transversely outward and which each essentially include, as can be seen from FIGS. 5A and 5B, a linking foot 38 which extends transversely outward from the corresponding bearing surface and which is extended, at its free end, by a catching end 40 which, in the proposed example, is approximately in the shape of a plate element parallel to the plane of the panel 12.

In the example illustrated, the support 14 includes two attachment tabs 36 at its front bearing surface 30 and two more tabs 36 at its rear bearing surface 32.

To fit the support 14, the latter is first of all brought, in a first approach movement, transversely from the inside outward, to bear against the interior face 34 of the panel 12 so that the tabs 36 engage through corresponding openings 22 and 28.

Next, when the support 14 has reached an intermediate fitting position in which these two bearing faces 30, 32 are bearing against the interior face 34, the support 14 is then moved longitudinally forward simply by sliding along the bodywork panel 12. During this catching movement, the catching ends 40 of each of the tabs 36 are intended to engage behind an exterior face 42 of the bodywork panel 12.

Figure 2A:
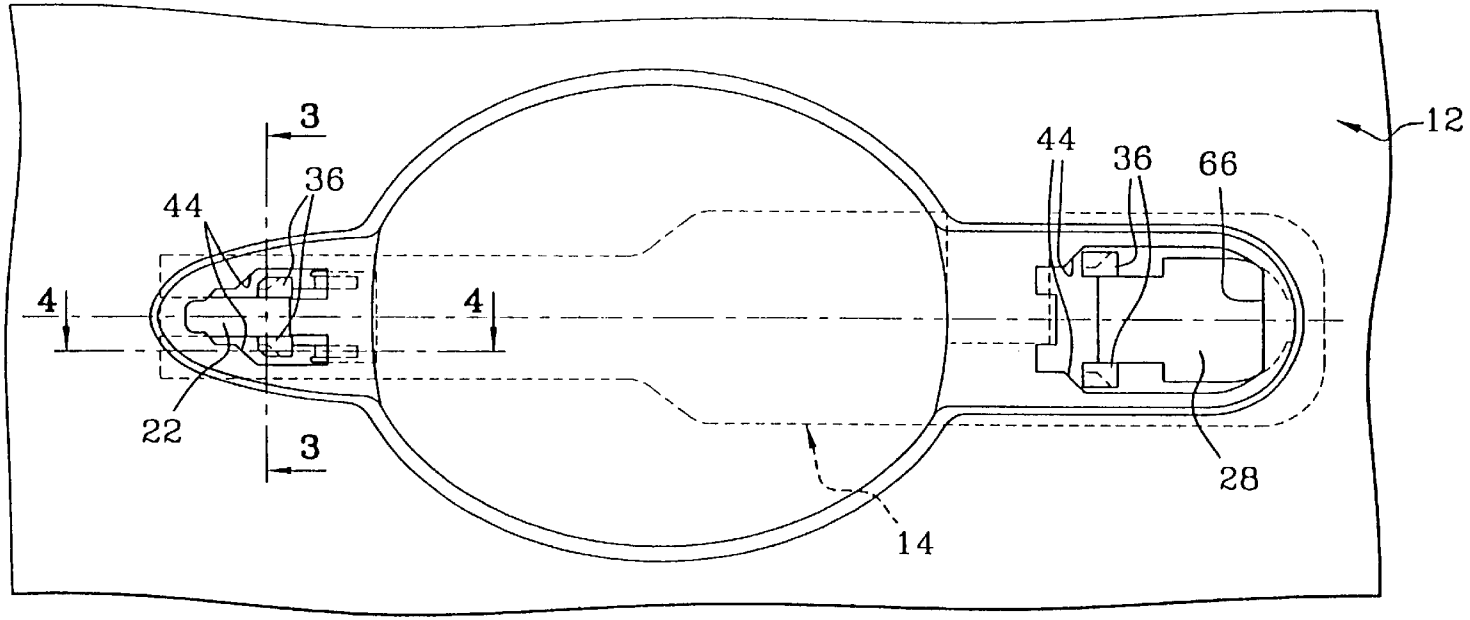
FIG. 2A is a plan view of the bodywork panel of FIG. 1, the handle support being depicted in an intermediate fitting position.
Figure 3A:
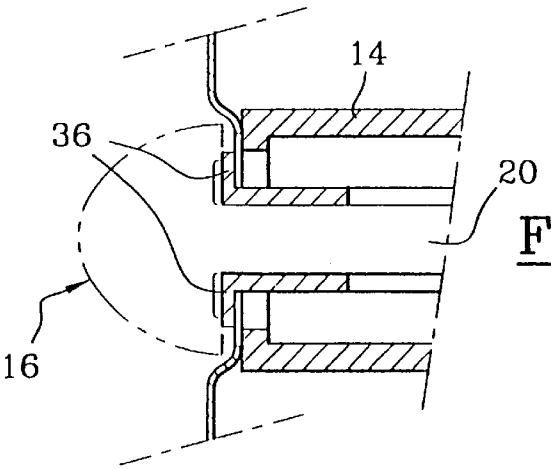
FIGS. 3A and 4A are diagrammatic views in section on the lines 3—3 and 4—4 of FIG. 2A.
Figure 2B:
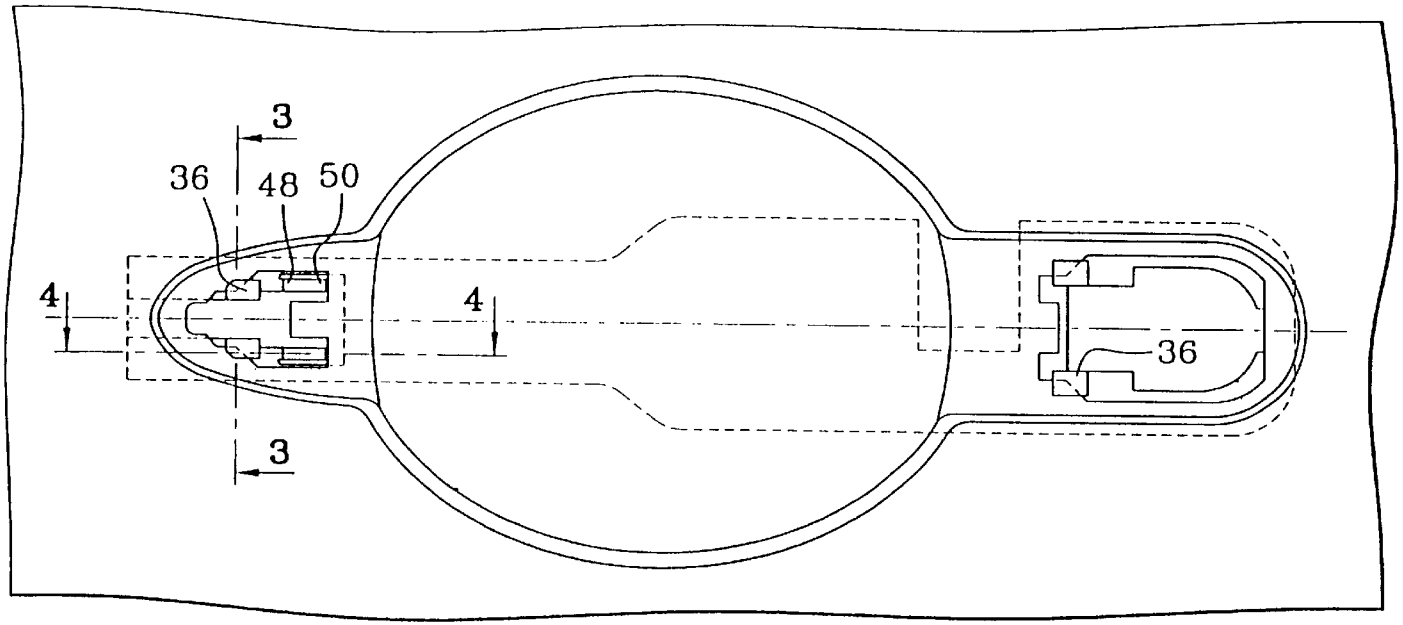
FIGS. 2B, 3B, 4B, 5B are figures similar to FIGS. 2A to 5A in which the handle support is depicted in the final fitted position.
Figure 3B:
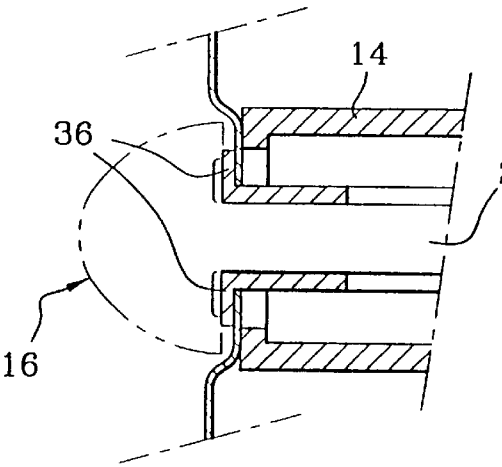

Specifically, as can be seen more particularly in FIGS. 2A and 2B, the front opening 22 and rear opening 28 include bearing edges 44 which lie in the path of the tabs 36 when the support 14 is moved longitudinally forward from its intermediate fitting position illustrated in FIG. 2A. In actual fact, only the linking foot 38 is intended to bear against the corresponding bearing edge 44. Specifically, the latter has a dimension in the transverse direction which is approximately equal to the thickness of the bodywork panel 12. In that way, when the support 14 is bearing against the interior face 32 of the panel 12, the plate-shaped catching end 40 is then arranged transversely outward with respect to the bodywork panel 12 so that, when the catching end 40 reaches one of the bearing edges 44, it cannot interfere with this edge. Also, as the catching movement of the support 14 continues, the catching end 40 of each tab 36 engages behind the exterior face 42 of the panel. By contrast, the linking foot 38 comes to bear against the corresponding edge 44 and therefore causes the longitudinal forward movement of the support 14 to stop.

Thus, when the support 14 has reached its furthest-forward longitudinal position, which corresponds to its final position, the tabs 36, via their catching ends 40, prevent the possibility of it being withdrawn transversely inward with respect to the bodywork panel 12.

In the embodiment illustrated, it can also be seen that the two bearing edges 44 of one and the same opening, for example the front opening 22, are arranged on one and the same vertical line perpendicular to the longitudinal direction of the movement of the support 14 between its intermediate position and its final position. Of course, in the same way, the corresponding tabs 36 are also aligned in the same direction.

The bearing edges 44 are inclined at about 45 degrees with respect to the longitudinal catching direction of the support 14. However, it can be seen that two edges 44 of the same opening 22, 28 are not parallel but on the other hand are approximately symmetric with respect to a longitudinal midplane. They thus define a V which, in this case, is open toward the rear.

In that way, when the linking feet 38 of the two tabs 36 simultaneously each come to bear against the corresponding edge 44, they not only longitudinally position the support 14 but also position it in the vertical direction perpendicular to the longitudinal direction, that is to say position it in the two directions of the plane of the panel 12.

Thus, the front end of the support is perfectly positioned with respect to the bodywork panel by virtue of its two catching tabs 36. Likewise, with the rear opening 28 also comprising two bearing edges 44 inclined so as to form a V, the two tabs 36 borne by the rear end of the support 14 also accurately position this part of the support 14.

Figure 6:
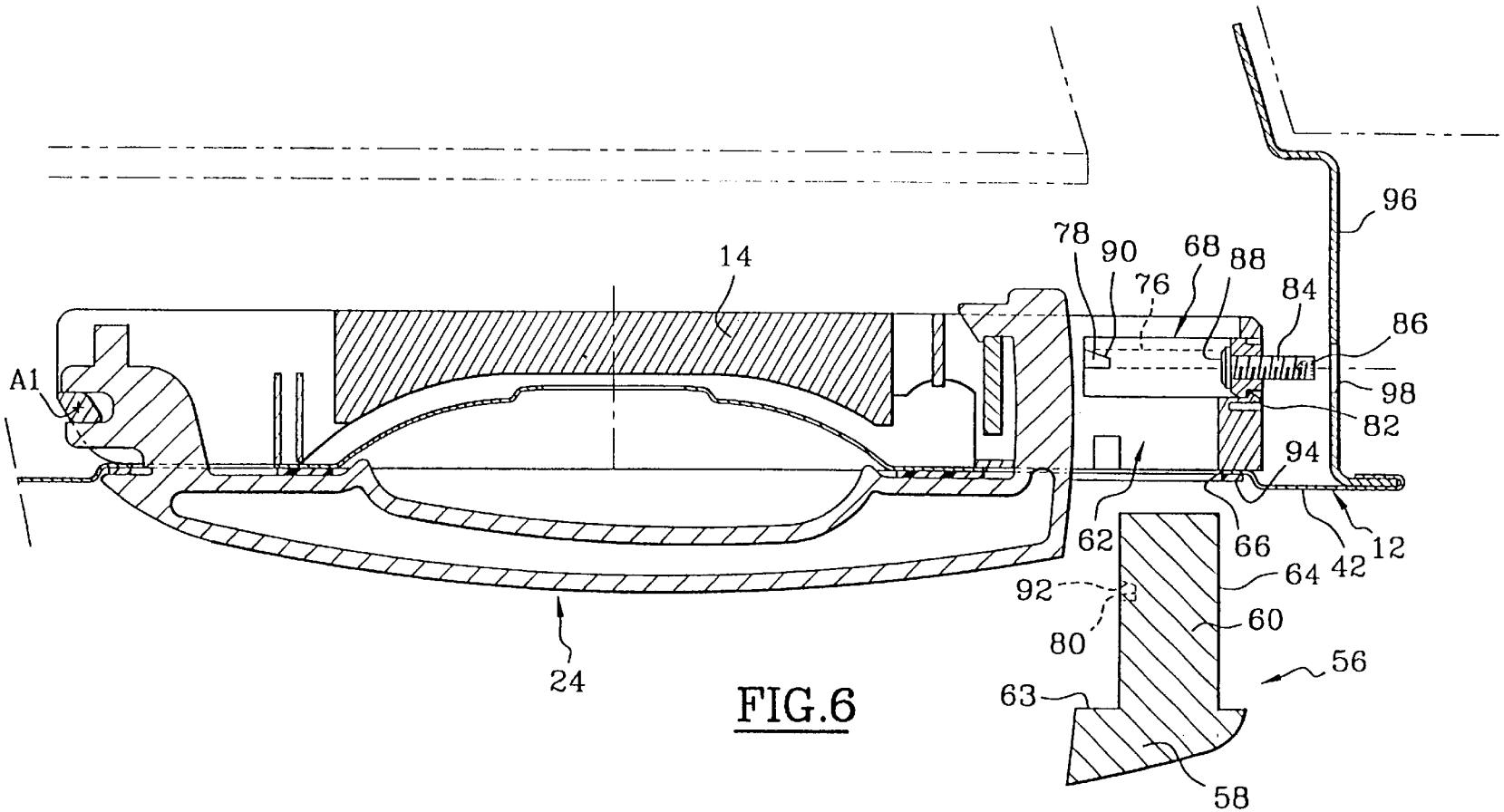
FIGS. 6, 7 and 8 are diagrammatic views in section on a longitudinal and transverse plane of the handle, which more particularly illustrate the fitting and immobilization of an additional locking body of the handle.

As can be seen more particularly in FIGS. 5 and 6, the linking feet 38 of the tabs 36 each have a bearing face 54 which faces to complement the orientation of the bearing edge 44 against which it is intended to bear.

Furthermore, according to another aspect of the invention, there are means which allow the support 14 to be automatically immobilized when it has reached its final position, so as to prevent it from retreating longitudinally backward with the risk of the catching tabs 36 disengaging.

To do this, it can be seen that the support 14 includes, at the rear of its front bearing surface 30, and more specifically to the rear of each of the tabs 36 borne by the latter, two elastic arms 48 which run approximately longitudinally, which are connected to the support 14 by their front end, and the rear end 50 of which runs transversely outward with respect to the plane of the bearing surface 30 when they are in the unconstrained state as illustrated in FIG. 1.

Figure 4A:
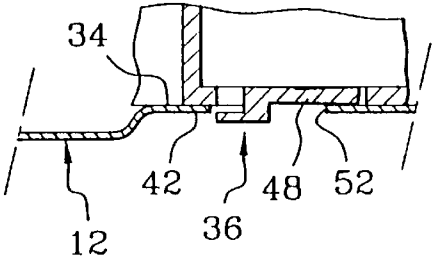

The elastic arms 48, which are formed integrally with the support, can be urged transversely inward so that they no longer transversely run outward beyond the plane of this surface. This is what happens when the support 14 is brought to bear against the interior face of the panel 12 as illustrated in FIG. 4A.

Figure 4B:
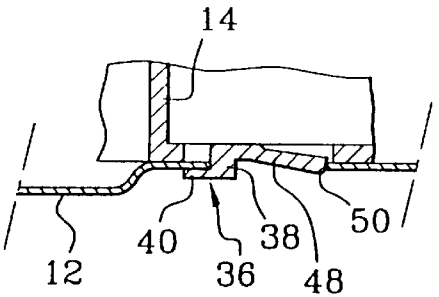

However, and as illustrated in FIG. 4B, when the support 14 reaches its final position, the elastic arms 48 face the front opening 22 so that they can revert to their unconstrained position. Their rear end 50 then finds itself longitudinally just in front of a rear edge 52 of the opening 22 again. Thus, extending transversely outward by a distance approximately equal to the thickness of the bodywork panel, the rear ends 50 of each of the arms 48 then find themselves bearing again, in the longitudinal direction, in the plane of the bodywork panel 12, against the rear edge 52 of the front opening 22 which forms a locking cutout, thus preventing the support 14 from moving back.

In the example illustrated, the bearing edges 44 corresponding to the front tabs 36 and the rear edges 52 against which the elastic arms 48 bear form part of the outline of the opening 22 through which the hinge element 29 of the grasping lever 16 runs. However, provision could obviously be made for each of its edges to form part of the outline of a specific opening.

As will be described with reference to FIGS. 6 to 12, the handle according to the invention includes additional locking means, the action of which combines with that of the elastic arms 48 which, in this case, are used essentially to prelock the handle support 14.

For this purpose, the handle includes a locking body 56 which exhibits an outer part 58 and an attachment tang 60 which runs transversely inward to be housed through the rear opening 28 in the outer bodywork panel 12 of the opening leaf and be guided in sliding in the transverse direction in a complementary cavity 62 formed in the handle support 14.

The outer part 58 has a bearing face 63 facing toward the exterior face 42 of the panel 12.

When the support 14 is in the final fitted position, the tang 60 of the locking body 56 is engaged transversely inward in the cavity 62 in the support 14 from the outside of the opening leaf so that the locking body 56 is thus immobilized with respect to the support 14 in all directions except the transverse direction. Now, at the same time, it can been seen in FIG. 12 that a rear lateral face 64 is then bearing longitudinally backward against a rear edge 66 of the rear opening 28. Also, the locking body 56 prevents any backward longitudinal withdrawal of the support 14 from the outer panel 12, and this eliminates any risk of the support 14 being removed should the elastic arms 48 break.

To secure the locking body in the cavity 62 of the support 14, the handle 10 includes a yoke 68 which is mounted to slide longitudinally in the rear part of the support 14. The yoke 68 essentially includes two longitudinal branches 70 connected at their rear end by a base 72 so that, in a plane perpendicular to the transverse direction, the yoke 68 is approximately in the shape of a U which is open forward.

At their front end, the branches 70 are each equipped with a lug 78, each lug 78 running approximately toward the opposite branch. As will be seen later, the lugs 78 are intended to be housed in complementary housings 80 formed in the tang 60.

The yoke 68 is intended to be engaged in a slideway 74 in the support 14 which opens longitudinally at the rear. The accurate guidance of the yoke 68 is provided, in particular, by rails 76 formed on the exterior faces of the branches 70 of the locking body 56.

Before the support 14 is fitted on the opening leaf, the yoke 68 is engaged longitudinally from the rear forward in the slideway 74 as far as a forward unlocked position in which the branches 70 run one on each side of the cavity 62, the lugs 78 being arranged at the front of the cavity so that the yoke 68 cannot prevent the tang 60 of the locking body 56 from being introduced into the cavity 62.

Figure 7:
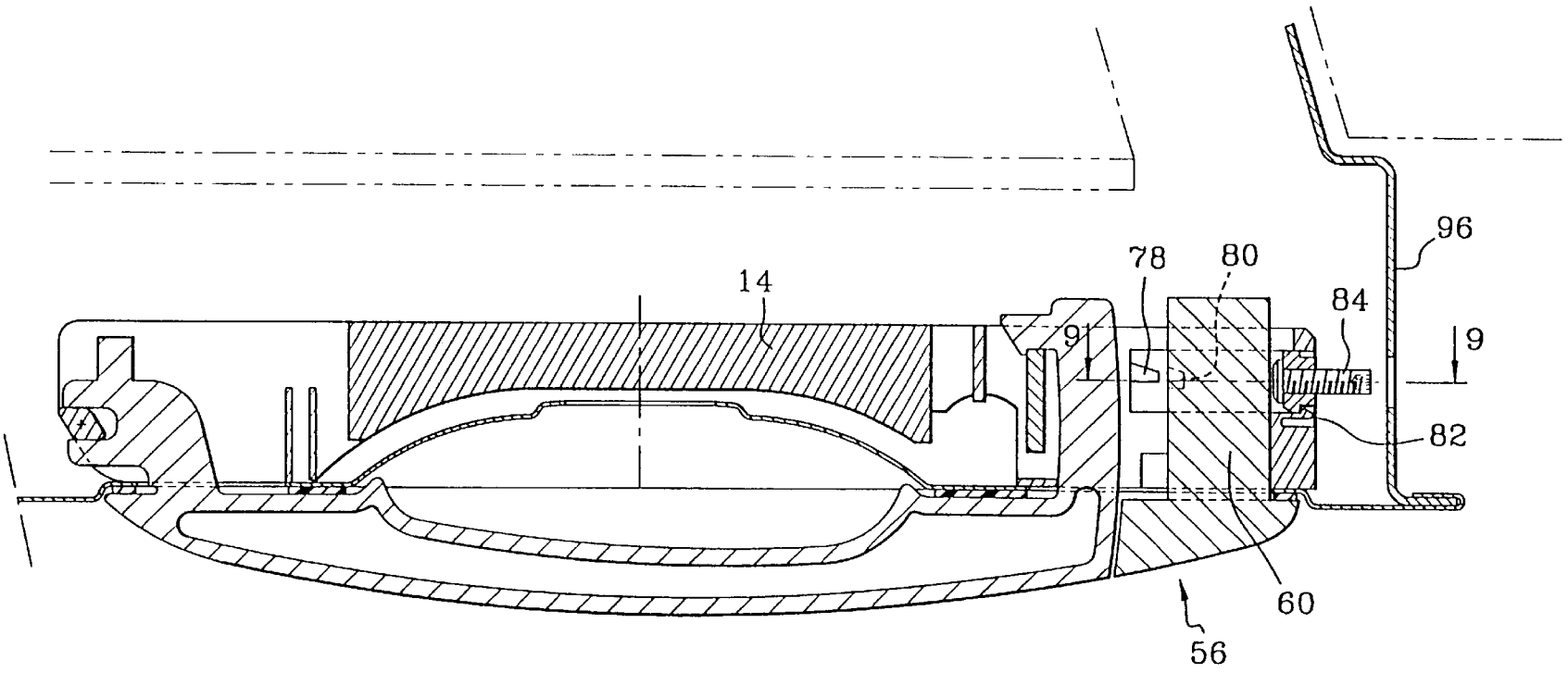

It will be noted in FIGS. 6 and 7 that the support 14 includes an elastic leaf 82 which retains the yoke 68 longitudinally in its forward unlocked position to prevent it from being able to escape from the slideway 74 simply under the effect of its own weight.

Figure 9:
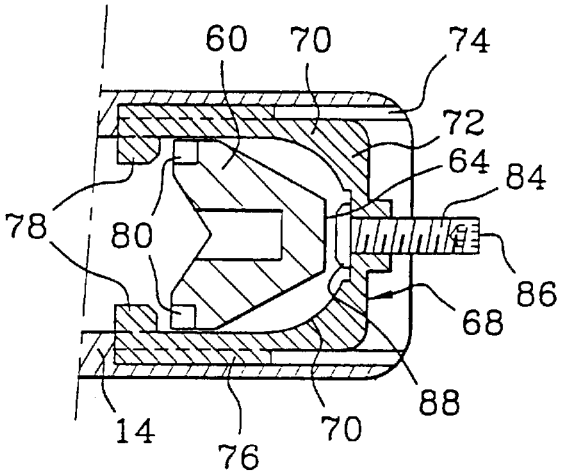
FIGS. 9 and 10 are views in section on the lines 9—9 and 10—10 respectively of FIGS. 7 and 8, illustrating the immobilization of the locking body.
Figure 10:
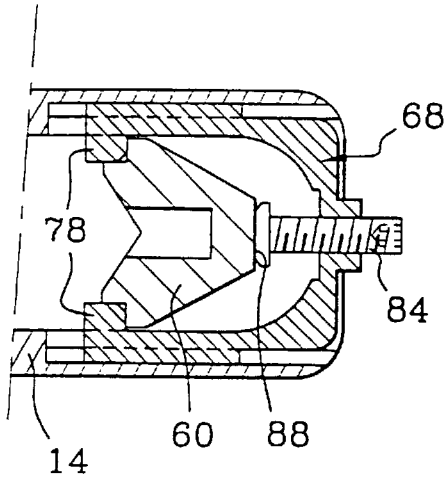
Figure 11:
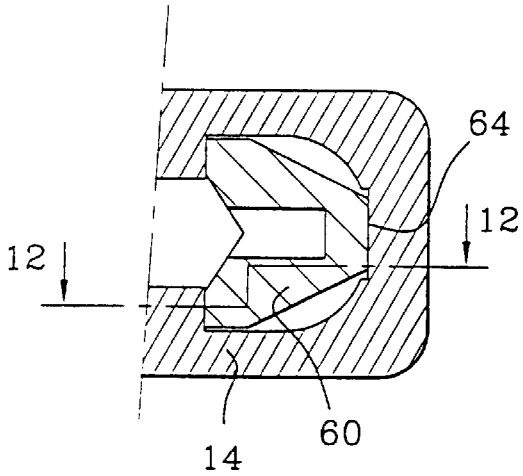
FIG. 11 is a view in section on the line 11—11 of FIG. 8 illustrating the guidance of the locking body in the handle support.
Figure 12:
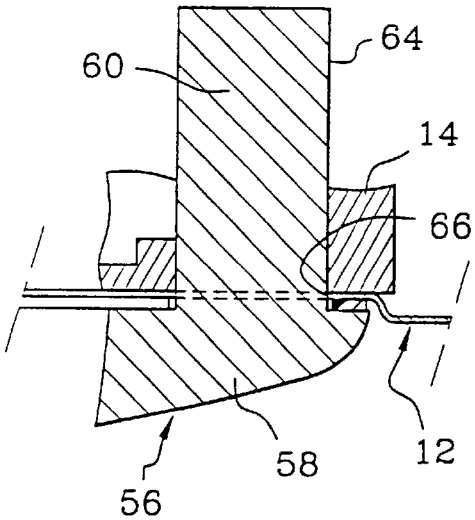
FIG. 12 is a view in section on the broken line 12—12 of FIG. 11.

When the tang 60 of the locking body 56 is engaged in the cavity 62, it can be seen from FIGS. 9 and 10 that it is housed between the two branches 70 of the yoke 68. Once the locking body 56 is in place, the housings 80 formed in its tang 60 are longitudinally facing the lugs 78 of the yoke 68.

According to one aspect of the invention, the yoke 68 is equipped with maneuvering means which allow it to be moved longitudinally back as far as a setback immobilizing position in which the lugs 78 are housed in the housings 80, which transversely immobilizes the locking body 56 with respect to the support 14, and therefore completely immobilizes it.

For this purpose, there is a threaded rod 84 with a longitudinal axis, which is screwed through the base 72 of the yoke. Its rear end, which runs behind the base 72, has an axial hexagon socket 86 which allows it to be manipulated using a tool of the hexagon key type. At its front end, the threaded rod 84 has a bearing cup 88 which is intended to bear axially forward against the rear lateral surface 64 of the tang 60 of the locking body 56. The front end of the rod 84 may also have a recessed socket to make the rod 84 easier to fit on the yoke 68, which is performed before the yoke 68 is introduced into the slideway 74 and therefore before the support 14 is fitted on the opening leaf.

As can be seen in FIGS. 9 and 10, it is thus possible, by turning the threaded rod 84 in the appropriate direction, to make the yoke 68 move back longitudinally with respect to the locking body 56, which is fixed in this direction, until the lugs 78 are brought into the housings 80.

Advantageously, the lugs 78 and the housings 80 have complementary inclined surfaces 90, 92 which, when the yoke is brought into its setback immobilizing position, collaborate in such a way that they cause the locking body 56 to move transversely inward, which allows the bearing face 63 of the body 56 to be clamped against the exterior face 42 of the outer panel 12. Advantageously, a seal 94 will be placed between the bearing face 63 and the panel 12.

The design of the immobilization of the locking body 56 is particularly advantageous in that it allows easy fitting and removal of the locking body on the support 14, but in cases where the latter is not accessible.

Figure 8:
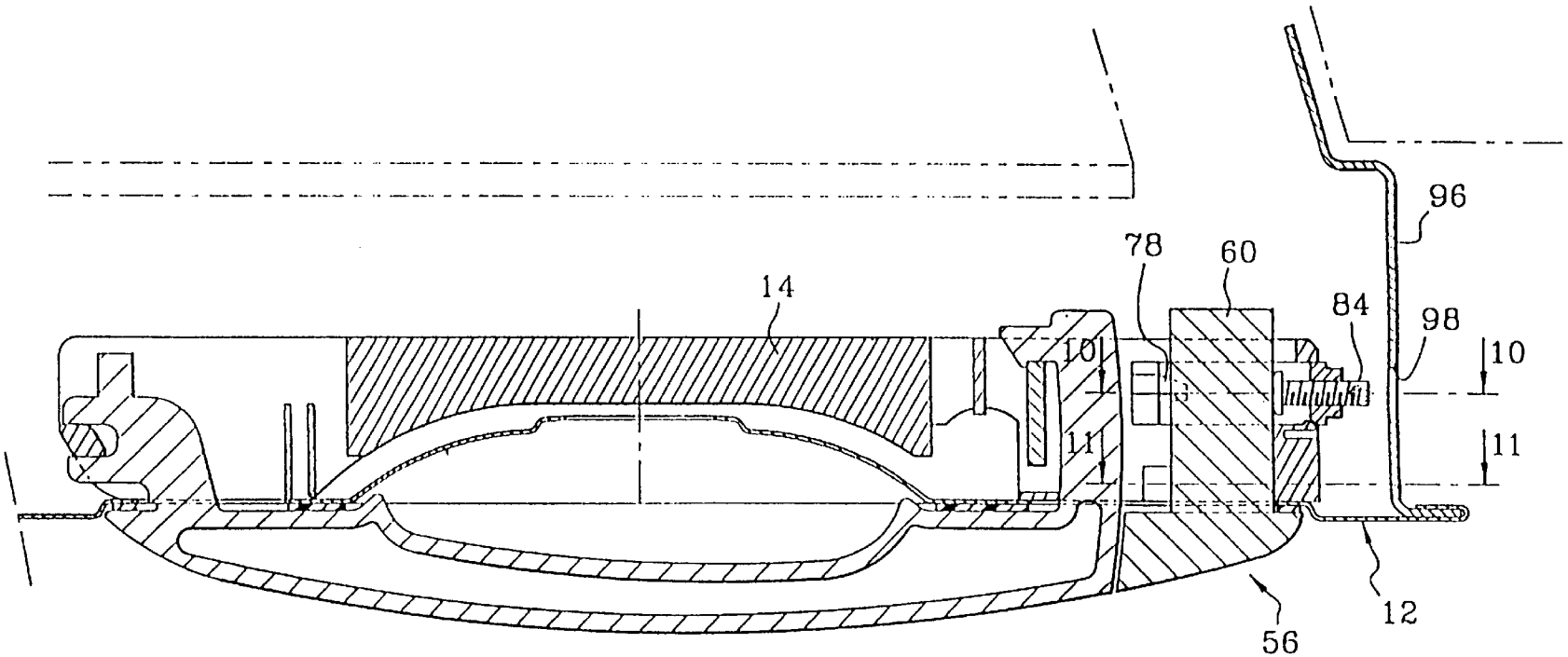

The problem is that the handle support 14 is generally fixed in an internal space of the opening leaf delimited by the outer panel 12, an inner panel parallel to the outer panel, and at least one edge panel 96 which runs transversely to connect the inner panel and the outer panel 12. The inner panel consists, for example, of a door lining. More specifically, as illustrated in FIGS. 6 to 8, the support 14 is generally arranged at a rear end of the opening leaf, near a vertical edge panel 96.

By virtue of the invention, all that is therefore required is for there to be provided, in the edge panel 96, facing the rear end of the threaded rod 84, a hole 98 for the passage of a tool that complements the socket 86. The locking body 56 can thus be immobilized or unlocked without having to access the space inside the panel, simply by engaging the tool through the hole 98 in order to turn the threaded rod 84.

In particular, for repairs which require only the outer parts of the handle to be removed, for example for repainting the bodywork panel, there will be no need to remove the inner panel of the opening leaf, while at the same time avoiding having to arrange the fastening means on the outside of the opening leaf. This removal can be done "blind", without there being any risk of losing the threaded rod 84 either as this threaded rod, by design, cannot be unscrewed out of the yoke 68 because of the presence of the radial enlargement formed by the bearing cup 88.

It has been seen in the foregoing that the locking body plays a part, in fixing the support 14 to the handle 10. However, it may also be envisaged for it also to play a part in holding and/or guiding the grasping lever 24.

Furthermore, the locking body 56 may also form a casing intended to house a latch for deadlocking the opening-leaf lock.

What is claimed is:

1. A motor vehicle opening-leaf handle, comprising:

a handle support fixable and substantially located on an inside of an outer bodywork panel; and a grasping member arrangeable on an outside of the outer bodywork panel, wherein the handle support includes catching tabs which attach the handle support to the panel, each tab including a linking foot and a catching end such that the support may be fitted on the panel through an approach movement perpendicular to the panel, from the inside outward, during which the tabs are engaged through an opening in the panel, and through a catching movement in a direction parallel to the panel, during which the catching end of the tab comes to face an exterior face of the bodywork panel, preventing any transversely inward retreat of the tab and of the support, and wherein the grasping member is fixed to the handle support across the bodywork panel.

2. The handle according to claim 1, wherein during the approach movement, the support is brought as far as an intermediate fitting position in which it is in contact with an interior face of the bodywork panel.

3. The handle according to claim 2, wherein during the catching movement, the support is brought as far as a final position in which a locking member prevents the support from returning to its intermediate fitting position.

4. The handle according to claim 3, wherein the locking member includes at least one elastic arm a free end of which bears against an interior face of the bodywork panel as long as the support is between its intermediate fitting position and its final position, and when the support reaches its final position, the end of the elastic arm collaborates with a locking cutout formed in the panel.

5. The handle according to claim 1, wherein when the support is in a final position, the foot of at least one of the tabs bears against a bearing edge of the opening in the panel so as to determine the final position of the support.

6. The handle according to claim 5, wherein the support includes at least two tabs which are offset one with respect to the other in a direction perpendicular to the catching direction, and the at least two tabs are intended to come to bear respectively against two bearing edges of the opening in the panel which are at an angle with respect to the catching direction and which run in directions which are approximately symmetric with respect to the catching direction, so as to determine the position of the support in the two directions of the plane of the panel.

7. The handle according to claim 1, wherein the grasping member is fixed to the handle support across the bodywork panel.

8. The handle according to claim 7, wherein the grasping member is articulated to the support so as to be able to be brought from a position of rest to a position for opening.

9. A motor vehicle opening-leaf handle of the kind including a handle support which is fixed on the inside of an outer bodywork panel of the opening leaf, wherein the handle support includes catching tabs which attach the handle support to the panel, each tab including a linking foot and a catching end such that the support may be fitted on the panel through an approach movement perpendicular to the panel, from the inside outward, during which the tabs are engaged through an opening in the panel, and through a catching movement in a direction parallel to the panel, during which the catching end of the tab comes to face an exterior face of the bodywork panel, preventing any transversely inward retreat of the tab and of the support, wherein during the approach movement, the support is brought as far as an intermediate fitting position in which it is in contact with an interior face of the bodywork panel, wherein during the catching movement, the support is brought as far as a final position in which a locking member prevents the support from returning to its intermediate fitting position, and wherein the locking member include a locking body fitted with an attachment tang which, when the handle support has reached its final position, is engaged transversely inward through an orifice made in the outer bodywork panel so as to be engaged in a complementary cavity in the handle support in such a way that a rear lateral surface of a tang bears against a rear edge of the orifice so as to prevent the assembly formed by the support and by the locking body from returning to the intermediate fitting position.

10. The handle according to claim 9, wherein the opening leaf includes an internal space delimited by two panels, inner and outer, which are connected by an edge panel, the handle support is arranged in the interior space of the opening leaf, and the handle includes a member for immobilizing the tang of the locking body in the cavity of the support, the immobilizing member being fitted so that it can move on the handle support and being maneuvered between an unlocked position and an immobilizing position by a maneuvering mechanism which can be manipulated through an opening made in the edge panel of the opening leaf.

11. The handle according to claim 10, wherein the immobilizing member is fitted so that it can slide in the support in a direction perpendicular to the transverse direction of engagement of the locking body, and the immobilizing member includes at least one lug which, in the immobilizing position, is housed in a complementary housing in the tang of the locking body to prevent the possibility of the locking body being extracted transversely outward.

12. The handle according to claim 11, wherein the lug and the housing collaborate via two complementary surfaces which are inclined with respect to the transverse direction of engagement of the locking body and with respect to the direction of sliding of the immobilizing member so that, when the immobilizing member is brought into its immobilizing position, the locking body is urged transversely inward by the lug of the immobilizing member.

13. The handle according to claim 9, wherein the tang of the locking body is guided in sliding in the transverse direction in the handle support.

14. The handle according to claim 13, wherein an immobilizing member has the shape of a U-shaped yoke with two parallel longitudinal branches connected at their rear end by a base which runs at right angles to the two branches, he yoke is introduced longitudinally from front to rear as far as a forward unlocked position, into a complementary slideway arranged at the rear of the support, and the yoke is brought by a maneuvering means longitudinally rearward as far as its immobilizing position in which lugs formed at the front ends of each branch are engaged in corresponding housings in the tang of the locking body, the latter then being housed between the two longitudinal branches of the immobilizing yoke.

15. The handle according to claim 14, wherein the handle support includes means for prepositioning the immobilizing member which, while the handle is being fitted, hold it in its unlocked position.

16. The handle according to claim 14, wherein the maneuvering means consist of a threaded rod of longitudinal axis which is screwed into the base of the yoke, the front end of which bears against a surface which is longitudinally fixed, and the rear end of which exhibits a socket which complements that of a manipulating tool which can be introduced through the opening in the edge panel of the opening leaf.

17. The handle according to claim 16, wherein the threaded rod rests against a lateral surface of the tang of the locking body.

18. The handle according to claim 9, wherein the locking body houses a latch.

* * * * *

UNITED STATES PATENT AND TRADEMARK OFFICE

CERTIFICATE OF CORRECTION

PATENT NO. : 6,401,302 B1
DATED : June 11, 2002
INVENTOR(S) : Josserand et al.

It is certified that error appears in the above-identified patent and that said Letters Patent is hereby corrected as shown below:

Title page,
Item [75], Inventors, please change “Turin” to -- Torino --.

Column 8,
Lines 40-42, please cancel claim 7 without prejudice.
Line 43, after “claim” change “7” to -- 1 --.

Column 9,
Line 1, after “member” change “include” to -- includes --.

Column 10,
Line 9, after “branches,” change “he” to -- the --.

Signed and Sealed this

Tenth Day of December, 2002

JAMES E. ROGAN
*Director of the United States Patent and Trademark Office*